US008068634B2

(12) United States Patent
Tsuchiya

(10) Patent No.: US 8,068,634 B2
(45) Date of Patent: Nov. 29, 2011

(54) DIAPHRAGM AND SPEAKER USING SAME

(75) Inventor: Goro Tsuchiya, Mie (JP)

(73) Assignee: Panasonic Corporation, Osaka (JP)

( * ) Notice: Subject to any disclaimer, the term of this patent is extended or adjusted under 35 U.S.C. 154(b) by 740 days.

(21) Appl. No.: 12/158,370

(22) PCT Filed: Feb. 20, 2007

(86) PCT No.: PCT/JP2007/053015

§ 371 (c)(1),
(2), (4) Date: Jun. 20, 2008

(87) PCT Pub. No.: WO2007/097294

PCT Pub. Date: Aug. 30, 2007

(65) Prior Publication Data

US 2009/0175487 A1 Jul. 9, 2009

(30) Foreign Application Priority Data

Feb. 20, 2006 (JP) ..... 2006-042151

(51) Int. Cl.
*H04R 1/00* (2006.01)

(52) U.S. Cl. ..... 381/425

(58) Field of Classification Search ..... 381/423–425
See application file for complete search history.

(56) References Cited

U.S. PATENT DOCUMENTS

| | | | | |
|---|---|---|---|---|
| 4,472,604 | A * | 9/1984 | Nakamura et al. | 381/425 |
| 4,817,165 | A * | 3/1989 | Amalaha | 381/425 |
| 2001/0053230 | A1 | 12/2001 | Azima et al. | |

FOREIGN PATENT DOCUMENTS

| | | | |
|---|---|---|---|
| JP | 53888 | | 10/1920 |
| JP | 33-9406 | | 7/1958 |
| JP | 50-089330 | U | 7/1975 |
| JP | 56-85489 | U | 7/1981 |
| JP | 56-085489 | U | 8/1981 |
| JP | 61-245798 | A | 11/1986 |
| JP | 63-158088 | U | 10/1988 |
| JP | 63-158088 | U | 10/1988 |
| JP | 2001-513967 | A | 9/2001 |
| JP | 2006-042151 | | 11/2010 |
| WO | WO 98/39947 | | 9/1998 |

OTHER PUBLICATIONS

International Search Report for PCT/JP2007/053015, dated Jun. 5, 2007.

* cited by examiner

*Primary Examiner* — Tuyen Nguyen
(74) *Attorney, Agent, or Firm* — RatnerPrestia

(57) ABSTRACT

A first enforcing rib, a second enforcing rib, and a third enforcing rib are integrally formed at least at one of a front side and a back side of a diaphragm, the first enforcing rib being formed as an aggregate of a plurality of hexagons, enhancing strength and achieving light weight of a speaker using the diaphragm, preventing a difficulty of the speaker in emitting an audio sound.

6 Claims, 3 Drawing Sheets

DIAPHRAGM AND SPEAKER USING SAME

This application is a U.S. National Phase Application of PCT International Application PCT/JP2007/053015.

TECHNICAL FIELD

This invention relates to a diaphragm and a speaker using the diaphragm.

BACKGROUND ART

A diaphragm for a speaker is made of synthetic resin. The diaphragm made of synthetic resin has an improved waterproof characteristic and is useful for an automobile speaker, for example. As prior art documental information pertaining to the invention, Unexamined Japanese Patent Publication No. S59-176995 is a publicly known, for instance.

The synthetic resin diaphragm, however, becomes heavy when it is formed thick for getting a similar strength as to a paper diaphragm, making it difficult to emit an audio sound.

SUMMARY OF THE INVENTION

The invention prevents a difficulty in emitting an audio sound.

A diaphragm of this invention is made of synthetic resin, and an enforcing rib is formed integrally with at least at one of a front side and a back side of the diaphragm.

Since at least one of the front side and the back side of the diaphragm is integrally formed with an enforcing rib, a sufficient strength is maintained with the diaphragm even when it is formed thin, and the diaphragm becomes light as it is thinned. This constitution prevents a difficulty of a speaker using the diaphragm in emitting an audio sound.

REFERENCE MARKS IN THE DRAWINGS

Figure 1:
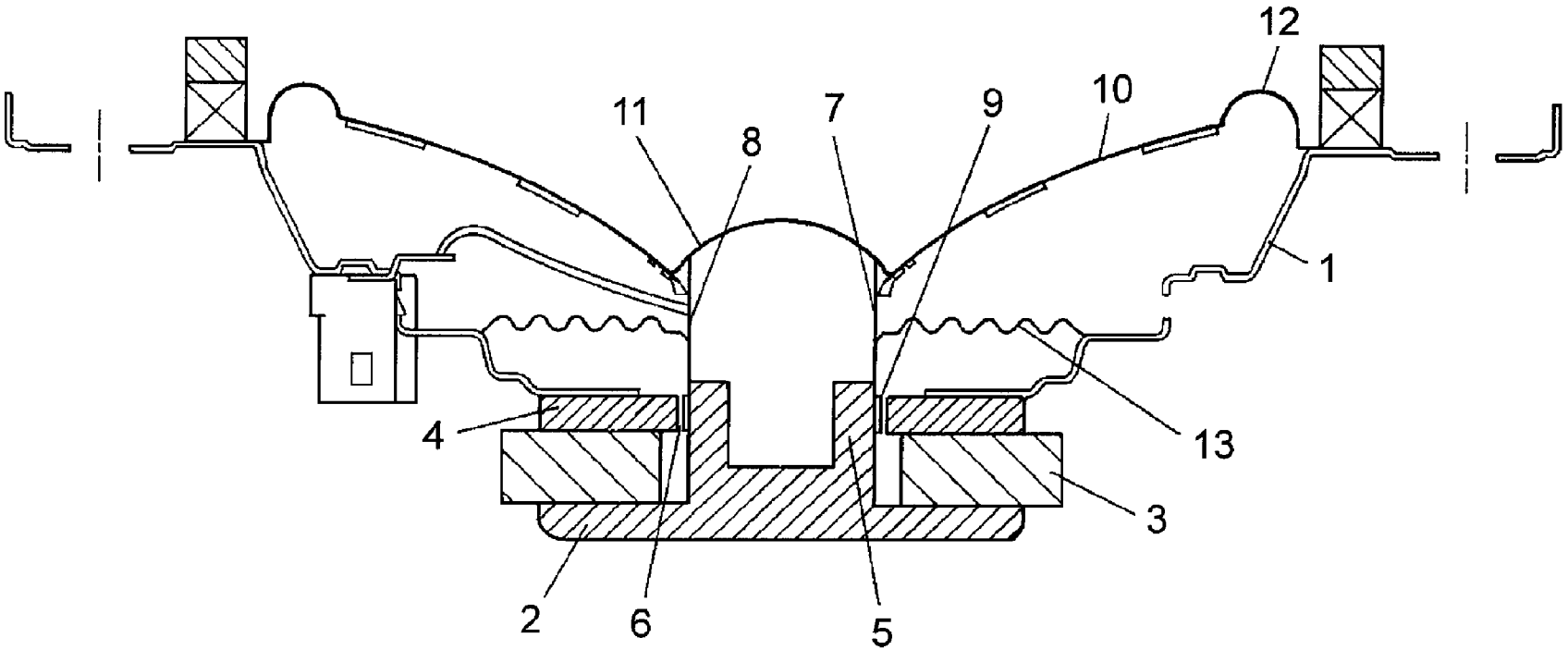
FIG. 1 is a cross-sectional view of a speaker in accordance with exemplary embodiment 1.

1. frame
2. magnetic circuit
7. voice coil
10. diaphragm
14. first enforcing rib
15. through-hole
16. second enforcing rib
17. third enforcing rib

DETAILED DESCRIPTION OF PREFERRED EMBODIMENTS

Exemplary Embodiment 1

Following, exemplary embodiment 1 is explained by using FIG. 1.

FIG. 1 is a cross-sectional view of a speaker in accordance with exemplary embodiment 1. Magnetic circuit 2 disposed at a central outer bottom of frame 1 in a conical shape is composed of magnet 3 in a disk shape, plate 4 in a disk shape and yoke 5 in a cylindrical shape, assembled and bonded together. Magnetic gap 6 a cylindrical space is formed between an outer peripheral side of a side wall of yoke 5 and an inner peripheral side of plate 4, opening to an upside of magnetic circuit 2.

Voice coil 7 is composed of coil 9 wound around an outer peripheral side of body 8 in a cylindrical shape. Voice coil 7 is placed movably in up and down directions in magnetic gap 6, vibrating diaphragm 10 formed in a thin plate shape and attached to an upper outer periphery of voice coil 7. On a top of voice coil 7, dust cap 11 is attached as a dust proof.

Diaphragm 10 is a sound source of the speaker and is made of synthetic resin. An outer periphery of diaphragm 10 is connected to an opening edge of frame 1 through edge 12 upwardly protruded. An inner periphery of diaphragm 10 is adhesively fixed (not illustrated) to an outer peripheral side of body 8 of coil 7. Edge 12 is made of material such as urethane, foamed rubber, SBR (styrene butadiene rubber) and cloth, for not applying a moving load to diaphragm 10.

An inner periphery of dumper 13 is adhesively fixed to voice coil 7 but closer to magnetic circuit 2 rather than to a joining part where the outer peripheral side of body 8 is fixed to diaphragm 10. An outer periphery of dumper 13 is fixed to frame 1. Dumper 13 is a corrugated sheet in a ring shape, expanding and contracting with a movement of voice coil 7. Dumper 13 is made of such as urethane, foamed rubber, SB R and cloth for not applying a moving load to diaphragm 10, same as edge 12.

Figure 2:
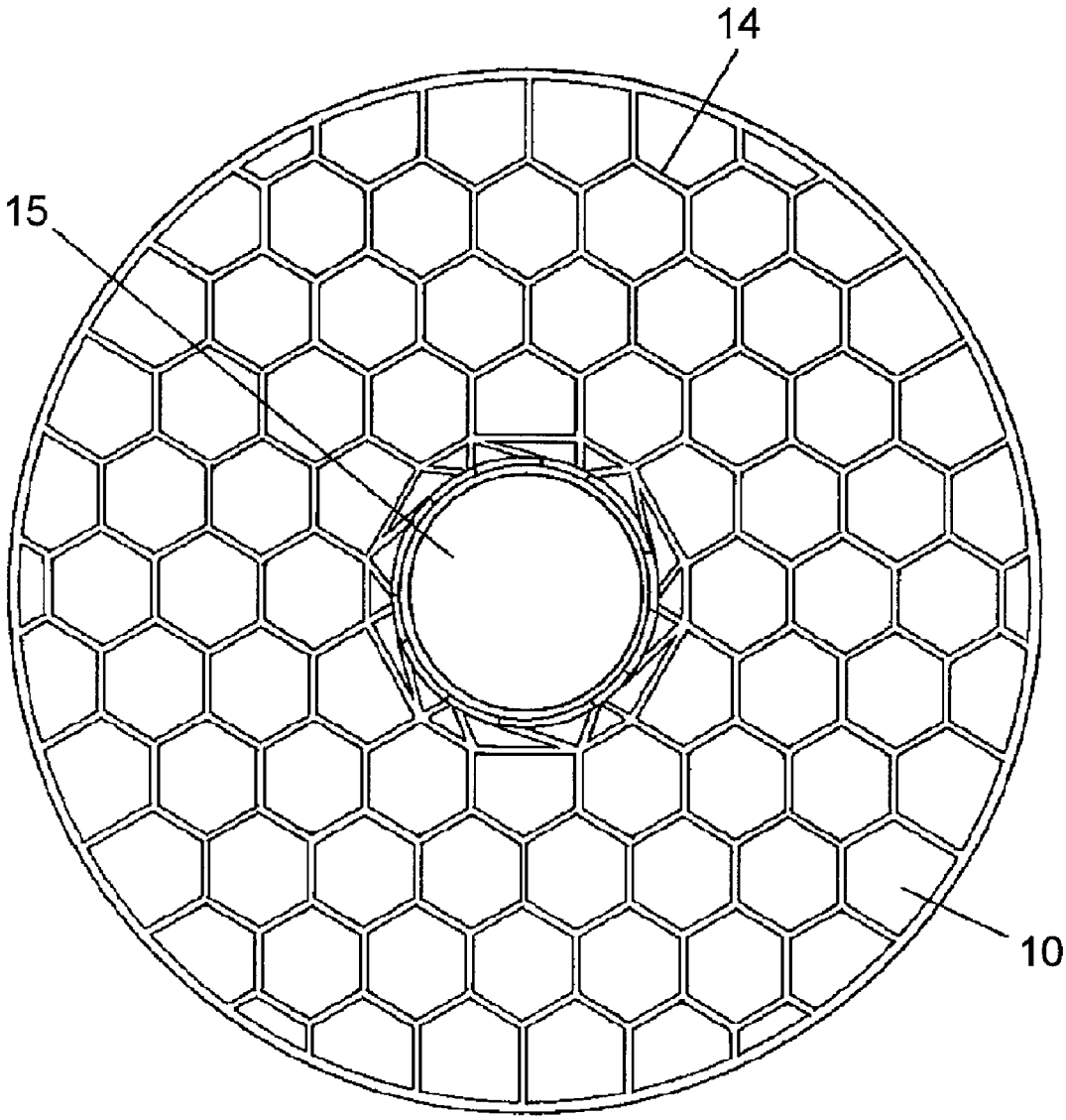
FIG. 2 is a plan view of a diaphragm to be used for the speaker in accordance with exemplary embodiment 1.
Figure 3:
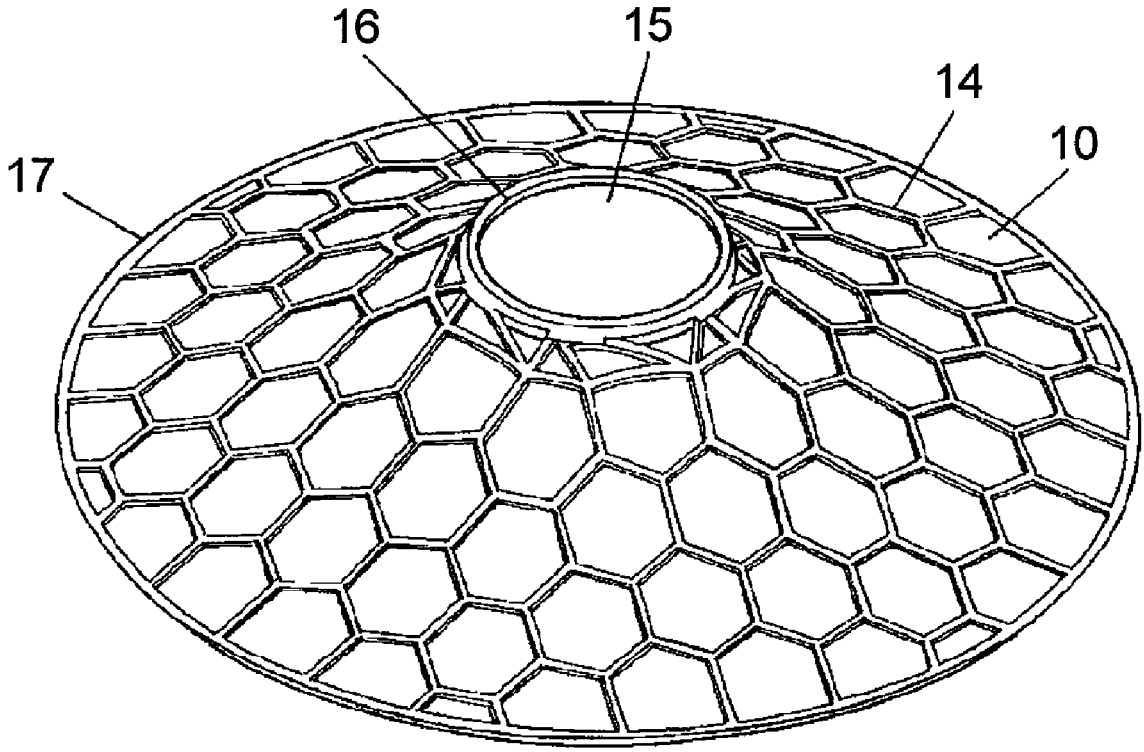
FIG. 3 is a perspective view of the diaphragm to be used for the speaker in accordance with exemplary embodiment 1.

With the structure, when a voice signal is applied to coil 7 of voice coil 9, voice coil 7 moves up and down in response to a magnetic field caused in magnetic gap 6, thereby vibrating diaphragm 10 and emitting a sound from the speaker. FIG. 2 is a plan view of a diaphragm to be used for the speaker in accordance with exemplary embodiment 1. FIG. 3 is a perspective view of the diaphragm to be used for the speaker in accordance with exemplary embodiment 1.

As shown in FIGS. 2 and 3, first enforcing rib 14, second enforcing rib 16 and third enforcing rib 17 are integrally molded with a rear side of the diaphragm of the speaker of the invention. First enforcing rib 14 is ordinarily formed as an aggregate of hexagons. Enforcing rib 14 does not have to be all hexagons but it can be partially polygons rather than hexagons.

Diaphragm 10 is in a disk shape in a plan view. In a center of the disk, through-hole 15 is formed, through which voice coil 7 passes and with which voice coil 7 is fixed. A molding density of first enforcing rib 14 around through-hole 15 is higher than a molding density of first enforcing rib 14 in an outward part of the through-hole. This structural arrangement of enforcing rib 14 strengthens through-hole 15 in fixing voice coil 7.

In order to further improve the fixing strength, second enforcing rib 16 and third enforcing rib 17 are formed in a ring shape around an outer periphery and an outermost periphery of through-hole 15.

Diaphragm 10 is molded integrally with first enforcing rib 14, second enforcing rib 16 and third enforcing rib 17 by an injection molding of synthetic resin. The injection molding starts from through-hole 15.

By doing the injection molding, planes enclosed by first enforcing rib 14, second enforcing rib 16 and third enforcing rib 17 are pulled by the enforcing ribs 14, 15 and 16 as synthetic resin is hardened, forming so called a sink in the planes. Consequently, the diaphragm is strengthened not only by first enforcing rib 14, second enforcing rib 16 and third enforcing rib 17, but also by the planes surrounded by the ribs, therewith preventing generation of unwanted vibration of diaphragm 10.

In this first exemplary embodiment, first enforcing rib 14, second enforcing rib 16 and third enforcing rib 17 are molded only on a back side of diaphragm 10. However, one or more of the enforcing ribs can be formed on a front side of diaphragm 10, providing a similar effect.

INDUSTRIAL APPLICABILITY

As mentioned above, with this invention, an enforcing rib is integrally molded with at lease one of front and back side of the diaphragm of this invention, so that even when the diaphragm is formed thin, a sufficient strength is secured. Furthermore, because the diaphragm becomes light as it is formed thin, a difficulty of the diaphragm in emitting an audio sound is prevented, making it very useful for a speaker.

The invention claimed is:

1. A diaphragm made of synthetic resin comprising:

a first enforcing rib, a second enforcing rib and a third enforcing rib being integrally formed at least at one of a front side and a back side of the diaphragm, wherein the first enforcing rib includes a plurality of hexagons extending between a through-hole and an edge of the diaphragm, and the second enforcing rib and the third enforcing rib are respectively formed at the through-hole and the edge of the diaphragm, and are a different shape than the first enforcing a rib.

2. The diaphragm of claim 1, wherein a molding density of the first enforcing rib formed around the through-hole is higher than a molding density of the first enforcing rib formed at an outer part of the through-hole.

3. The diaphragm of claim 2, wherein the second enforcing rib is formed at an outer periphery of the through-hole in a ring shape and the third enforcing rib is formed at the edge of diaphragm in a ring shape.

4. A speaker comprising:

a diaphragm of claim 1.

5. A speaker comprising:

a diaphragm of claim 2.

6. A speaker comprising:

a diaphragm of claim 3.

* * * * *